United States Patent [19]

Makara

[11] Patent Number: 4,477,020

[45] Date of Patent: Oct. 16, 1984

[54] VENTILATING AND HEATING APPARATUS AND HEAT-SENSITIVE UNIT

[75] Inventor: György Makara, Budapest, Hungary

[73] Assignee: Futober Epuletgepeszeti Termekeket Gyarto Vallalat, Budapest, Hungary

[21] Appl. No.: 296,349

[22] Filed: Aug. 26, 1981

[30] Foreign Application Priority Data

Sep. 16, 1980 [HU] Hungary ..... 2279/80

[51] Int. Cl.[3] ..... F24F 7/00

[52] U.S. Cl. ..... 236/49; 237/46; 236/46 R

[58] Field of Search ..... 237/46; 236/49, 46 R; 165/16, 22, 59; 62/180

[56] References Cited

U.S. PATENT DOCUMENTS 4,353,412 10/1982 Krumhansl ..... 165/59

*Primary Examiner*—Albert J. Makay
*Assistant Examiner*—Henry Bennett
*Attorney, Agent, or Firm*—Handal & Morofsky

[57] ABSTRACT

The invention relates to a ventilating and heating apparatus for rooms of particularly high headrooms. It comprises one or more air-heating units and one or more room heating units. A feature of the apparatus is that the room is equipped with ventilating openings directed to the sojourn space of the room, injecting in summer and drawing in winter as well as with ventilating openings directed to the space under the ceiling, injecting in winter and drawing in summer. The power regulator unit of the air heating unit and the power regulator unit of the room heating unit are in connection with an automatic regulator unit forcing first the air heating unit, afterwards the room heating unit to decrease their power if the value of heat sensation indicated by the sensor unit of heat sensation exceeds an a longer period an adjusted equilibrium value; and inversely, forcing first the room heating unit, afterwards the air heating unit of the room to increase their power if a lower value of heat sensation is indicated on a longer period. The sensor unit of heat sensation is featured in that its sensing element is in connection with an electric heater of at least 30 W/m$^2$ power related to the surface of its cover, supplying a heating of expediently instant and selectable or adjustable power during operation.

15 Claims, 3 Drawing Figures

VENTILATING AND HEATING APPARATUS AND HEAT-SENSITIVE UNIT

Figure 1:
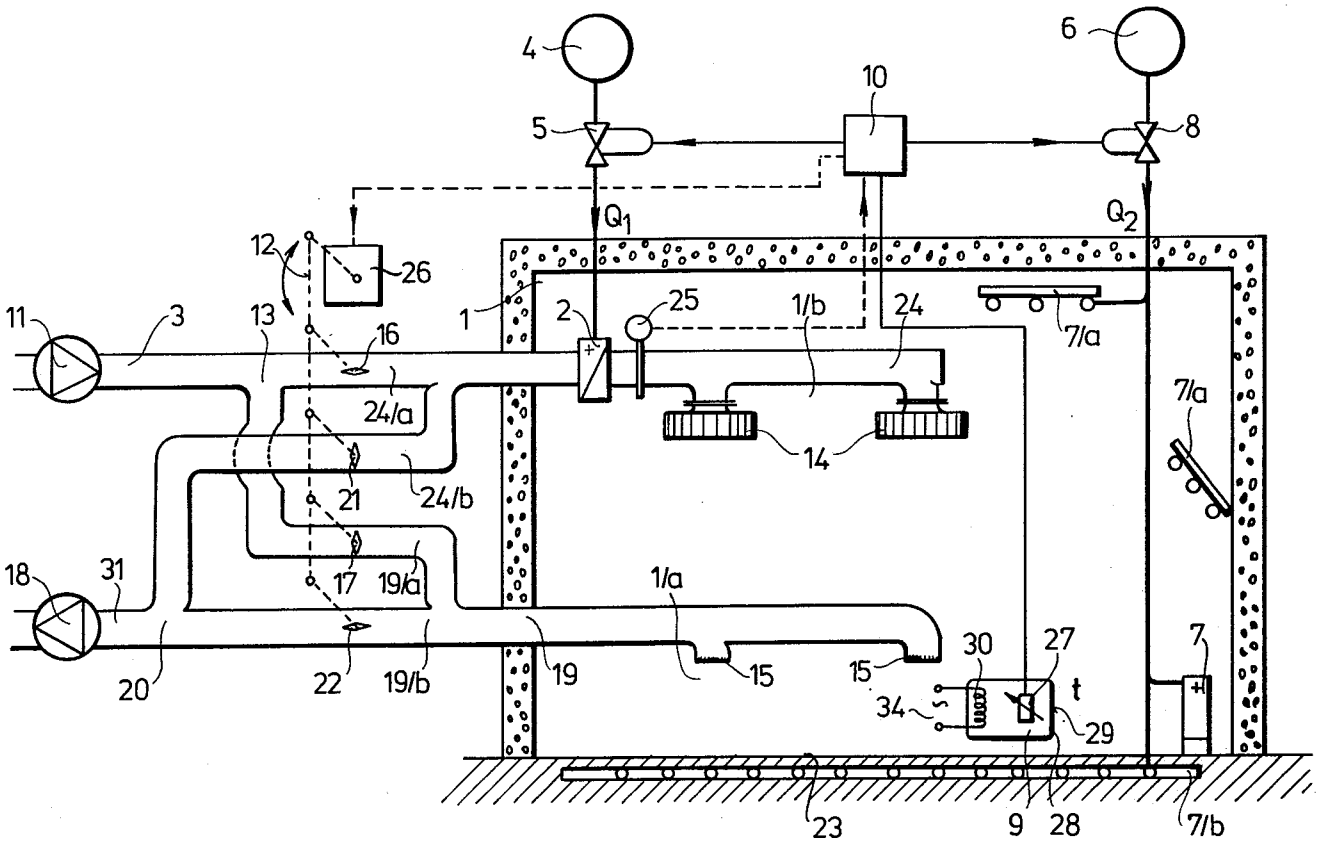

This invention relates to a ventilating and heating apparatus for use in the energy-saving perflation of and in keeping temperature at a desired value in spaces of high headroom. The apparatus is equipped with units for feeding and removing air into or from the room to be ventilated and/or to be heated, and in this particular case equipped with one or more air heating units suitable for heating the ventilating air and with one or more room heating units for heating the room.

Power regulating units and a heat sensitive unit of heat sensation are assigned to both the air heating and the room heating units.

The different kinds of the known ventilating and heating equipment have considerable deficiencies. These are manifested in the vertical temperature variation of the room, in the considerable amount of heat energy spent for heating the air in the room, in the so-called winter-summer short-circuit and in the unfavourable features of perflation of the room.

In winter, the most widely used, combined ventilating and heating equipment types inject the ventilating air into the room at such a temperature that its heat content should cover at least a considerable amount of the heat loss of the room. In this particular case, no individual heaters for the room are applied or - if any - merely to such an extent, that they should give the room a certain, so-called basic heating that is necessary even in the standstill of the ventilation.

The drawback of the different kinds of known equipment mentioned lies in that they blow the air into the room in an arbitrary direction, and the air injected - mingled with the air in the room - lifts to the space under the ceiling, as a result of its less specific weight. Accordingly, there is an undesirable lamination of temperature in the room in winter. That is, the space under the ceiling must have a high temperature in order to obtain proper temperature in the zone of sojourn. As a result, a lot of energy is wasted, because the exilting air of high temperature drives off a considerable amount of heat from the room.

A part of the lifting, intermingled air exits because of the features of the building construction, while the other part exits through the air-feeding openings next to the ceiling of the ventilating system - partly by way of short-circuiting - without permeating the zone of sojourn and contributing to refresh the air there. Accordingly, this short-circuited ventilating air consumes the energy of heating without any benefits.

In another family of the known ventilating and heating equipment self-containing, integral room heating constuctions are effected. They can be situated in space limiting walls or in ceilings, or in other cases they are radiating or convective heaters, possibly heaters of so-called recirculating flow. These kinds of ventilating equipment in winter blow in fresh air heated to the temperature of the room into the space of the room.

The automatic power regulators of the equipment mentioned were effected according to the known method in such a way that both the radiators of the room and those of the air comprised a separate, self-containing power regulator. According to another method an automatic regulator was effected that was connected to the heat-sensitive unit of the room by an unpreferable sensor of heat sensation, and this automatic regulator forced the regulator units of the radiators of the room and the air to modify their power. The equipment mentioned later is more preferred to those mentioned earlier, but the air heated by the radiators lifts even in this case unimpededly to the upper space of the room. As a consequence, in winter here also arises the disadvantageous temperature lamination and the energy wasting due to it.

Another disadvantageous feature of the known types of ventilating and heating equipment is that they blow in and draw off the ventilating air through the same openings both in winter and in summer. As a result, the drawback of energy wasting and those concerning the permeation of the room are not eliminated during the summer or during the winter run, or in some cases, in either seasons.

In most types of the known equipment the ventilating air is blown in to the upper part of the air space, and accordingly, in winter the warm, but fresh air blast blown in above does not get to its destination, to the zone of sojourn, whereas in summer the air blast deflected down from above may cause feeling of draught in the zone of sojourn while it takes a part of the heat content of the warm air that has lifted before.

For eliminating these drawbacks an air-injecting construction equipped with a winter air-injecting surface directed downwards and a summer one directed in different directions has been developed in Switzerland. The basic idea of the method is correct, but it did not proved good in practice, because in summer the blown-in cold air returns a part of the warmed air lifted and used up to the zone of sojourn, thus decreasing the vertical temperatur lamination being advantageous in summer.

The known sensor units of heat sensation used in the ventilating and heating equipment comprise temperature sensors usually situated in some protective case. At the same time, their disadvantage also lies in that. Namely, the measured value of temperature is influenced mainly by the temperature of the air contacting the protective case and partly by the intensity of heat radiation, while it is not effected by the speed of the moving air, though the heat sensation is considerably influenced by that and by heat radiation.

Some of the sensor units of heat sensation are also heated by a small heating power of the measuring current of the sensing element situated in the unit and operated by electric current, while other units comprise, on the surface or inside, an electric heater that can be switched on and off by an automatic regulator. In a typical embodiment of the latter the electric heater performs a so-called thermical feed-back. That is, when the heating is switched on by the thermostat, the thermical feed-back heating also remains switched on for the duration of the switched-on period. This way, it can faster sense the effect following its own regulation. According to another method, the electric heater placed in thermostats is used to offset thermically some adjusted base valve e.g. by keeping the heater in a switched on position for the duration of the decreased night heating.

The object of the present invention is to develop a ventilating and heating equipment - mainly for hall-shaped rooms of high headroom - which eliminates the energetically unfavourable temperature lamination and allows the ventilation to operate without short-circuitry both in winter and in summer. Another object of the invention is to utilize the energy-saving of ventilation and heating resulting from heat radiation better than before during the heating season in rooms heated by heat radiation.

An additional object of the invention is to provide a sensor unit of heat sensation sensing not only the effect of environmental temperature and heat convection, but also the air speed at the automatic regulator of the ventilating and heating equipment.

What is more, the regulator unit of the ventilating and heating equipment can be adjusted according to the heat sensation requirements depending on the intensity of activity and on the clothing of people staying in the room. The invention is based on the perception that air of lower temperature than that in the room can be injected into the space under the ceiling in a so-called fractional load operational mode by way of an air injecting mechanism that can be operated without draught, if the energy needed for heating the injected air is also supplied by the power of the room radiators, in addition to the natural heat loss of the room. The importance lies in that the cold ventilating air cools continuously the space under the ceiling, the air space of the room is well permeated, and an inner circulation arises in the air space that strives for homogenizing that space.

In other words, the perception lies in that it is not worth while decreasing the power of heating the room while the heat power being unnecessary in respect of heating can be utilized by decreasing the temperature of the ventilating air. This way energy can be saved both in heating and in ventilation, in a longer time particularly in case of floor heating or radiation heating directed to the floor. According to the object set, the ventilating and heating apparatus according to the invention, used in energy-saving perflation of rooms of high headroom and in keeping their temperature at a desired level - the apparatus comprising units for injecting and removing air into/from the room to be ventilated and/or heated, in this particular case one or more air heating units suitable for heating the ventilating air and one or more room heating units suitable for heating the room, where power regulator units and sensor units of heat sensation are attached to both the air heating and to the room heating units - is effected in such a way that the room is equipped with ventilating openings directed to its space of sojourn used in summer for injection, in winter for drawing-off, and other ventilating openings directed into a space outside the space of sojourn expediently into the space under the ceiling, used in winter for injection, in summer for drawing-off, and/or the power regulator unit of the one or more air heating units and the power regulator unit of the one or more room heating unit are in connection with an automatic regulator unit, where the automatic regulator unit forces first the air heating unit then the room heating unit to decrease their own power, if the value measured by the sensor unit of heat sensation exceeds on a longer period the value adjusted to an equilibrium base value ($t_o$), and reversely, it forces first the room heating unit then the air heating unit to increase their power, if the value of heat sensation is lower on a longer period.

The ventilating and heating apparatus according to the invention can be further characterized in that the ventilating openings of the sojourn space are connected to a common duct, and the ventilating openings of the space under the ceiling are also connected to a common air duct, the two air ducts are in connection in an alternative way with an injecting ventilator and with a drawing ventilator. Both the air duct of the sojourn space and that of the space under the ceiling can be divided into an injecting duct leading to the injecting ventilator and a drawing duct leading to the drawing ventilator.

The space on the injecting side of the injecting ventilator is in connection with the injecting ducts of the air ducts through a forked tube, while the space on the drawing side of the drawing ventilator is in connection with the drawing ducts of the air ducts also through a forked tube. An air locking unit, e.g. a locking dog is effected in both injecting ducts of the air ducts in an opposite position to one another that is, the one in the injecting duct leading to the sojourn space is closed in winter operation and is open in summer operation, while the other in the injecting duct leading to the space under the ceiling is open in winter operation and is closed in summer operation.

In a similar way, an air locking unit, e.g. locking dog is effected in both drawing ducts of the air ducts in an opposite position to one another, that is, the one in the drawing duct leading to the sojourn space is open in winter operation and is closed in summer operation, while the other in the drawing duct leading to the space under the ceiling is closed in winter operation and is open in summer operation. The locking units, e.g. locking dogs of the injecting ducts are in a reverse position through e.g. a mechanical forced coupling.

In another possible embodiment a four-way forked tube is inserted between the space on the injecting side of the injecting ventilator and the space on the drawing side of the drawing ventilator, where both the airduct of the sojourn space and the airduct of the space under the ceiling are connected to. Inside the four-way forked tube a locking dog is effected, connecting the space on the injecting side of the injecting ventilator to the air duct of the sojourn space, as well as the space on the drawing side of the drawing ventilator to the air duct of the space under the ceiling in its summer position, while connecting the space on the injecting side of the injecting ventilator to the air duct of the space under the ceiling, as well as the space on the drawing side of the drawing ventilator, to the air duct of the sojourn space in its winter position.

The power regulator unit of the air heating unit is connected between the air heating unit and its power supply unit, and so is the power regulator unit of the room heating unit between the room heating unit and its power supply unit, and both power regulator units are in connection with the automatic regulator unit. A unit, e.g. a thermostat controlling the minimal temperature value of the injected air is effected in the airduct of the space under the celing between the ventilating openings and the air heating unit, and is in connection with the automatic regulating unit. The room heating unit comprises radiant heaters and/or floor heaters situated under the floor of the room.

Also according to the present invention there is provided a sensor unit of heat sensation, comprising a heat-sensitive sensor unit situated inside or on the surface of the cover, where the sensing element is in connection with an electric heater of at least 30 $W/m^2$ power regarding to the surface of the cover, where the heating is expediently of constant and selectable or adjustable power.

The energy saving representing the main advantage of the ventilating and heating apparatus is due to that in winter the temperature lamination of the air space of the room can be kept at a minimum by expediently blowing in cold ventilating air into the space under the ceiling and drawing off the exiting air from beneath. In other words, the warm air lifting to the space under the ceiling is forced to return to the sojourn space by drawing off the air from beneath and by intermingling the cold air above.

In summer, on the other hand - when just the reverse phenomenon is desirable, that is, not to force the air that has lifted to return to the sojourn space to be cooled - the fresh air is blown into the very lower air space to obtain good permeation and as good vertical temperature lamination as possible. This way, not only fresh air is injected into the sojourn space, but a pleasant move of air is also induced.

It is unnecessary to form individual winter and summer ventilation apparata independent of one another to achieve the favourable circumstances mentioned - and this is a considerable advantage in respect of the investment. Namely, the desired modes of operation can be effected by properly branching and by closing and opening, respecitvely, the air ducts or by using reversible ventilators.

When setting the operation mode, the ventilating openings of the space under the ceiling are connected in winter to the injecting ventilator, in summer to the drawing ventilator, while the ventilating openings of the sojourn space are connected in winter to the drawing, in summer to the injecting ventilator. In another case the reversible ventilators used for injection in winter and connected to those openings can be operated in summer as drawing ventilators, and the ventilators used for drawing-off in winter can be operated in summer as injecting ventilators. Another considerable advantage lies in using a sensor unit of heat sensation according to the invention. Instead of the known thermostats limiting the heat energy saving, the sensor unit developed by the inventors "copies" the temperature and heat loss of man by having a sensing element heated for a longer period, thus it can respond not only to the effects of temperature and radiation, but even to the change in air speed, similarly as people can. It can even respond according to clothing and to activity by expediently selecting the heating power.

Figure 2:
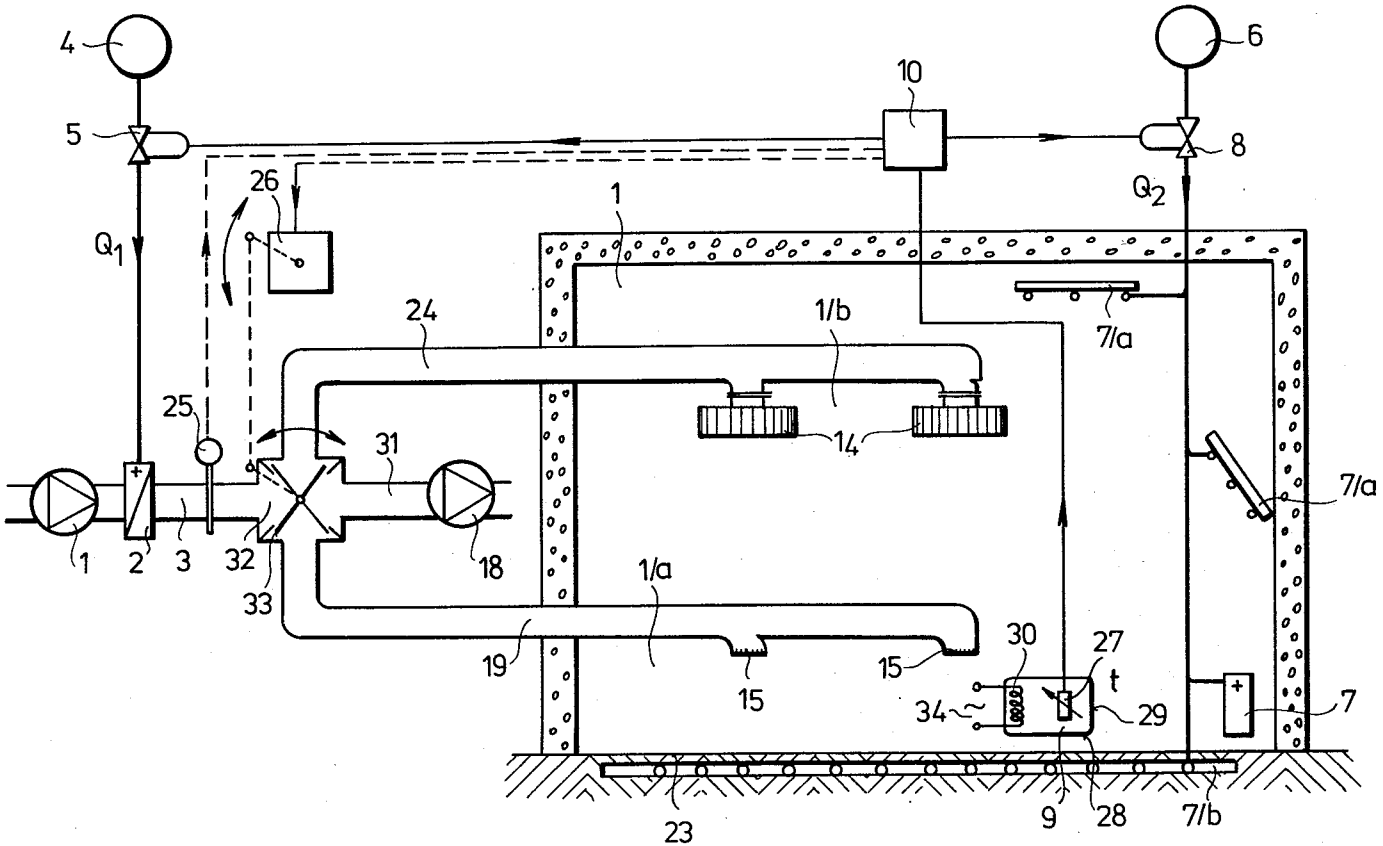
Figure 3:
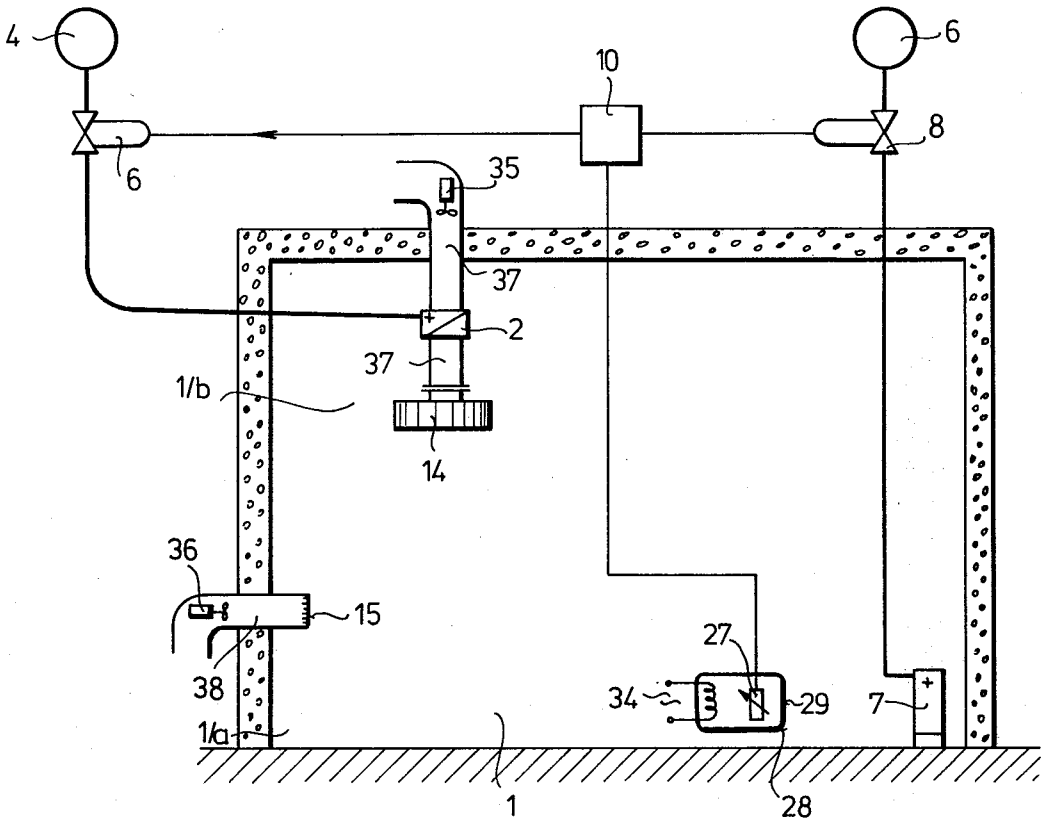

The object will now be described in details by way of an example, with reference to the accompanying drawings, in which FIG. 1 illustrates a possible embodiment of the apparatus according to the invention together with a sensor unit of heat sensation related to it;

FIG. 2 illustrates another possible embodiment of connecting the air ducts and the ventilating openings;

FIG. 3 a possible way of connecting the ventilating openings and the ventilators.

The room 1 where the air heating unit 2 and the room heating unit 7 are situated is shown schematically in FIG. 1. The latter can be effected as a group of radiant heaters 7*a* and/or floor heaters 7*b* situated under the floor.

The air heating unit 2 is connected to the power supply unit 4, as well as the room heating unit 7 to the power supply unit 6. In both cases the power regulator units 5 and 8, respectively, are situated between the power supplies 4 and 6, respectively, and the heating units 2 and 7, respectively, are apt to induce the air heating unit 2 and the room heating unit 7, respectively to reduce the heat output transmitted.

The aforementioned power regulator units 5 and 8 are in connection with the automatic regulator unit 10. The automatic regulator unit 10 is suited for inducing the air heating unit 2 to transmit smaller or larger heat output through the power regulator unit 5, as well as the room heating unit 7 through the power regulator unit 8. The automatic regulator unit 10 is also in connection with the sensor unit of heat sensation 9 according to the invention.

Control is realized by adjusting the automatic regulating unit 10 to an equilibrium base value $t_o$. If the sensor unit of heat sensation 9 indicates that the parameter of heat sensation exceeds the equilibrium base value $t_o$ on a longer period, then the automatic regulator unit 10 first induces the air heating unit 2 through the power regulator unit 5, afterwards the room heating unit 7 through the power regulator unit 8 to decrease their power.

In the inverse case the sequence of the operation will also be reversed. Accordingly, if the sensor unit of heat sensation 9 indicates that the parameter of heat sensation is less than the equilibrium base value $t_o$ on a longer period, then the automatic regulator unit 10 first induces the room heating unit 7 through the power regulator unit 8, afterwards the air heating unit 2 through the power regulator unit 5 to transmit more heat power.

The air used in heating and ventilating is injected into the interior of room 1 through the ventilating opening 15 situated in the sojourn space 1*a* and through the ventilating openings 14 situated in the space 16 under the ceiling.

FIG. 1 shows that the air duct 19 of the ventilating openings 15, as well as the air duct 24 of the ventilating openings 14 can be connected to both the injecting ventilator 11 and the drawing ventilator 18. It is also shown that the air duct 19 is in connection with the injecting ventilator 11 through its injecting branch 19*a*, with the drawing ventilator 18 through its drawing branch 19*b*, and so is the air duct 24 with the injecting ventilator 11 through its drawing branch 24 and with the drawing ventilator 18 through its drawing branch 24*b*.

A forked shape 13 connected to the space 3 on the injecting side of the injecting ventilator 11 and a forked shape 20 connected to the space 31 on the drawing side of the drawing ventilator 18 are effected to connect the individual air duct sections with the ventilators 11 and 18.

FIG. 1 also shows that locking dogs 17 and 22 as air blocking units are situated in the injecting and drawing branches 19*a* and 19*b* the air duct 19 and so are the locking dogs 16 and 21 in the injecting and drawing branches 24*a* and 24*b* of the air duct 24. These locking dogs 16, 17 and 22, 21 respectively, can be connected to one another through e.g. a mechanical forced coupling 12.

Due to the coupling, the ventilators 11 and 18 can inject air into and draw off from, respectively, the desired spot of the room 1. In the case, the mechanical forced coupling 12 can be operated with some mover unit 26 that can be in connection with the automatic regulator unit 10.

In addition to the power regulator 5 and 8, the sensor unit of heat sensation 9 and the aforementioned mover unit 26, the automatic regulator unit 10 can also be inconnection with an additional thermostat 25, suitable for limiting the minimum temperature of the air injected to the air space under the ceiling 1*b*.

The main part of the sensor unit of heat sensation 9 is a sensing element, that can be accommodated inside or on the surface 29 of the cover 28 and is in connection with the electric heater 30, the power of which is at least 30 $W/m^2$, and facilitating the sensor unit of heat sensation 9 to copy the human heat loss. The electric heater 30 is connected to the current source 34 the voltage of which can be adjusted arbitrarily by way of e.g. a potentiometer control.

FIG. 2 illustrates another possible embodiment for connecting the air ducts 19 and 24 to the ventilators 11 and 18. Accordingly, the injecting ventilator 11 and the drawing ventilator 18 are in connection with the air ducts 19 and 24 through a four-way forked shape 32. The latter inside accomodates the locking dog 33 that in one of his two alternative positions - in the so-called summer operation belonging to the position illustrated by thin lines - connects the space 3 on the injecting side of the injecting ventilator 11 to the air duct 19 of the sojourn space 1*a* of room 1, while connecting the space 31 on the drawing side of the drawing ventilator 18 to the air duct 24 of the space under the ceiling 1*b*.

In quite a similar way, - in case of winter operation illustrated by fat lines - in the other position of same locking dog 33 it connects the injecting ventilator 11 to the air duct 24 of the space under the ceiling 1*b*, and the drawing ventilator 18 to the air duct 19 of the sojourn space 1*a*. There is shown in FIG. 3 that the air duct 38 belonging to the ventilating opening 15 of the sojourn space 1*a* accommodates the ventilator 36, and the air duct 37 belonging to the ventilating opening 14 of the space under the ceiling 1*b* accommodates the ventilator 35. The sense of transport of both ventilators 35 and 36 can be reversed. In the case the air heating unit 2 is also situated in the air duct 37 and is in connection with the power supply 4. The power regulator unit 5 is effected between them.

I claim:

1. Ventilating and heating apparatus for use in the energy saving perflation of and in keeping temperature at a desired value in spaces of high headroom, the apparatus comprising units for injecting and removing air into/from the room to be ventilated and/or heated, at least one air heating unit suitable for heating the ventilating air, and at least one room heating unit suitable for heating the room, and wherein individual power regulator units and sensor units for heat sensing are assigned to said air heating and room heating units, characterized in that the room (1) accommodated ventilating openings (15) directed to the lower lying sojourn space (1*a*) of the room, used in summer for injection, in winter for drawing-off, as well as ventilating openings (14) directed to the space outside the lower lying sojourn space (1*a*), expediently to the space (1*b*) under the ceiling, used in winter for injection, in summer for drawing-off; the power regulator unit (5) of each said air heating units (2) and the power regulator unit (8) of each said room heating unit (7) are connected with an automatic regulator (10) forcing first the air heating unit (2), afterwards the room heating unit (7) to decrease their power if the value of heat sensation indicated by the sensor unit of heat sensation (9) exceeds during a predetermined time period an adjusted equilibrium base value ($t_o$); and inversely, forcing first the room heating unit (7), afterwards the air heating unit (2) to increase their power if a lower value of heat sensation is indicated during a predetermined time period.

2. Ventilating and heating apparatus as claimed in claim 1, characterized in that the ventilating openings (15) of the sojourn space (1*a*) are connected to a common air duct (10), same as the ventilating openings (14) of the space (1*b*) under the ceiling are connected to another common air duct (24), and both ventilators (19,24) are in connection with an injecting ventilator (11) and a drawing ventilator (18) in an alternative fashion.

3. Ventilating and heating apparatus as claimed in claim 1 characterized in that the air duct (19) of the sojourn space (1*a*) is divided into an injecting branch (19*a*) leading to the injecting ventilator (11) and into a drawing branch (19*a*) leading to the drawing ventilator (18), the air duct (24) of the space (1*b*) under the ceiling is divided into an injecting branch (24*a*) leading to the injecting ventilator (11) and into a drawing branch (24*b*) leading to the drawing ventilator (18).

4. Ventilating and heating apparatus as claimed in claim 1 characterized in that the space (3) on the injecting side of the injecting ventilator (11) is in connection with the injecting branches (19*a*,24*a*) of the air ducts (19,24) through a forked shape (13), the space (31) on the drawing side of the drawing ventilator (18) is in connection with the drawing branches (19*b*,24*b*) of the drawing ventilators (19,24) through another forked shape (20).

5. Ventilating and heating apparatus as claimed in claim 4, characterized in that air locking units comprising locking dogs (17) are situated in the injecting branches (19*a*,24*a*) of the air ducts (19,20) in opposite direction one another; the one in the injecting branch (19) leading to the sojourn space (1*a*) is closed in winter operation and is opened in summer operation, the other in the injecting branch (24*a*) leading to the space (1*b*) under the ceiling is opened in winter operation and is closed in summer operation.

6. Ventilating and heating apparatus as claimed in claim 4, characterized in that air locking units comprising locking dogs (22) are situated in the drawing branches (19*b*,24*b*) of the air ducts (19,24) in opposite direction to one another; the one in the drawing branch (19*b*) leading to the sojourn space (1*a*) is opened in winter operation and is closed in summer operation, the other in the drawing branch (24*b*) leading to the space (1*b*) under the ceiling is closed in winter operation and is opened in the summer operation.

7. Ventilating and heating apparatus as claimed in claim 5, characterized in that the locking units comprising locking dogs (17,16) of the injecting branches (19*a*,24*a*) are in connection with one another through a mechanical forced coupling (12) in positions of opposite sense to one another.

8. Ventilating and heating apparatus as claimed in claim 1, characterized in that a four way forked shape (32) is effected between the space (3) on the injecting side of the injecting ventilator (11) and the space (31) on the drawing side of the drawing ventilator (18), to which both the air duct (19) of the sojourn space (1*a*) and the air duct (24) of the space (1*b*) under the ceiling are connected.

9. Ventilating and heating apparatus as claimed in claim 8, characterized in that the four way forked shape (32) comprises a locking dog (33) connecting in summer position the space (3) on the injecting side of the injecting ventilator (11) to the air duct (10) of the sojourn space (1*a*), and the space (31) on the drawing side of the drawing ventilator (18) to the air duct (24) of the space (1*b*) under the ceiling, said four way forked shape (32) connecting in winter position the space (3) on the injecting side of the injecting ventilator (11) to the air duct

(24) of the space (1*b*) under the ceiling, and the space (31) on the drawing side of the drawing ventilator (18) to the air duct (19) of the sojourn space (1*a*).

10. Ventilating and heating apparatus as claimed in claim 1, characterized in that a reversible ventilator (36) is switched in summer to the rotational position of injecting, in winter to the rotational position of drawing and is assigned to the ventilating openings (15) of the sojourn space (1*a*), another reversible ventilator (35) switched in summer to the rotational position of drawing, in winter to the rotational position of injecting and is assigned to the ventilating openings (14) of the space outside the sojourn space (1*a*), expediently of the space (1*b*) under the ceiling.

11. Ventilating and heating apparatus for use in the energy saving perflation of and in keeping temperature at a desired value in spaces of high headroom, the apparatus comprising units for injecting and removing air into/from the room to be ventilated and/or heated, at least one air heating unit suitable for heating the ventilating air, and at least one room heating unit suitable for heating the room, and wherein a power regulator unit and a sensor unit for heat sensing are assigned to said air heating and room heating units, characterized in that the room (1) accommodates ventilating openings (15) directed to the lower lying sojourn space (1*a*) of the room, used in summer for injection, in winter for drawing-off, as well as ventilating openings (14) directed to the space outside the sojourn sapce (1*a*), expediently to the space (1*b*) under the ceiling, used in winter for injection, in summer for drawing-off; and the power regulator unit (5) of said or each air heating unit (2) and the power regulator unit (8) of said room heating units (7) are connected with an automatic regulator (10) forcing first the air heating unit (2), afterwards the room heating unit (7) to decrease their power if the value of heat sensation indicated by the sensor unit of heat sensation (9) exceeds during a predetermined time period an adjusted equilibrium base value ($t_o$); and inversely, forcing first the room heating unit (7), afterwards the air heating unit (2) to increase their power if a lower value of heat sensation is indicated during a predetermined time period, said power regulator unit (5) of the air heating unit (2) is disposed between the air heating unit (2) and its power supply (4), the power regulator unit (8) of the room heating unit (7) is disposed between the room heating unit (7) and its power supply (6), and both power regulator units (5,8) are connected with the automatic regulator unit (10).

12. Ventilating and heating apparatus for use in the energy saving perflation of and in keeping temperature at a desired value in spaces of high headroom, the apparatus comprising units for injecting and removing air into/from the room to be ventilated and/or heated, at least one air heating unit suitable for heating the ventilating air, and at least one room heating unit suitable for heating the room, and wherein a power regulator unit and a sensor unit for heat sensing are assigned to said air heating and room heating units, characterized in that the room (1) accommodates ventilating openings (15) directed to the lower lying sojourn space (1*a*) of the room, used in summer for injection, in winter for drawing-off, as well as ventilating openings (14) directed to the space outside the lower lying sojourn space (1*a*), expediently to the space (1*b*) under the ceiling, used in winter for injection, in summer for drawing-off; and/or the power regulator unit (5) of said or each air heating unit (2) and the power regulator unit (8) of said or each room heating unit (7) are connected with an automatic regulator (10) forcing first the air heating unit (2), afterwards the room heating unit (7) to decrease their power if the value of heat sensation indicated by the sensor unit of heat sensation (9) exceeds during a predetermined time period an adjusted equilibrium base value ($t_o$); and inversely, forcing first the room heating unit (7), afterwards the air heating unit (2) to increase their power if a lower value of heat sensation is indicated during a predetermined time period, said power regulator unit (5) of the air heating unit (2) and its power supply (4), the power regulator unit (8) of the room heating unit (7) is disposed between the room heating unit (7) and its power supply (6), and both power regulator units (5,8) are connected with the automatic regulator unit (10), wherein a unit is provided for utilizing the heat content of air exiting the room (1), e.g. a heat pump, a regenerative heat exchanger, a recuperative heat exchanger, etc.

13. An embodiment of the ventilating and heating apparatus as claimed in claim 12, characterized in that a unit controling the minimum temperature of injected-air, e.g. a thermostat (25) is effected in the air duct (19) of the space (1*b*) under the ceiling, between the ventilating openings (14) and the air heating unit (2), and it is in connection with the automatic regulator unit (10).

14. An embodiment of the ventilating and heating apparatus as claimed in claim 12, characterized in that the room heating unit (7) comprises radiating heaters (7*a*) and/or floor heaters (7*b*) situated under the floor (23) of the room (1).

15. Ventilating and heating apparatus as claimed in claim 1, comprising a heat sensing element characterized in that the sensing element (27) is in connection with an electric heater (30) of at least 30 $W/m^2$ power related to the surface (28*a*) of th cover (28) supplying a constant and selectable heating.

* * * * *